US011749234B2

(12) United States Patent
Palumbo

(10) Patent No.: US 11,749,234 B2
(45) Date of Patent: Sep. 5, 2023

(54) HAND-HELD TOOL

(71) Applicant: Frank Thomas Palumbo, Ambler, PA (US)

(72) Inventor: Frank Thomas Palumbo, Ambler, PA (US)

( * ) Notice: Subject to any disclaimer, the term of this patent is extended or adjusted under 35 U.S.C. 154(b) by 0 days.

(21) Appl. No.: 17/085,827

(22) Filed: Oct. 30, 2020

(65) Prior Publication Data

US 2022/0084487 A1 Mar. 17, 2022

Related U.S. Application Data

(60) Provisional application No. 63/036,680, filed on Jun. 9, 2020.

(51) Int. Cl.
*G10D 3/173* (2020.01)

(52) U.S. Cl.
CPC ..... *G10D 3/173* (2020.02)

(58) Field of Classification Search
CPC ..... G10D 3/173; G10D 3/00; G10D 1/08; G10D 1/10
See application file for complete search history.

(56) References Cited

U.S. PATENT DOCUMENTS

| | | | | |
|---|---|---|---|---|
| 3,319,505 | A * | 5/1967 | Galetzky | G10D 3/173 84/322 |
| 6,245,977 | B1 * | 6/2001 | Byrns | G10D 3/173 84/322 |
| 6,815,597 | B1 * | 11/2004 | Bosley | G10D 3/173 84/322 |
| 2003/0183061 | A1 * | 10/2003 | Van Pamel | G10D 3/10 84/297 S |

* cited by examiner

*Primary Examiner* — Kimberly R Lockett
(74) *Attorney, Agent, or Firm* — LANDMARK INTELLECTUAL PROPERTY LAW, PLLC; Gregory Murphy

(57) ABSTRACT

The invention is generally directed to a tool formed from a single material including an engagement portion to contact or engage a target material or item; a handle portion; and one or more openings such that a user may maintain skin-to-skin contact between the user's fingers, thumb, and/or hand. In accordance with some embodiments, the invention is directed to a tool that may also include: a pinch portion between the handle portion and the engagement portion, to be gripped or pinched by a user, the pinch portion comprising one or more openings or orifices such that skin-to-skin contact is maintained during use; and one or more protrusions, indents, textures, ridges, or other surface features on the pinch portion or handle portion to assist with a user's grip of the tool.

16 Claims, 4 Drawing Sheets

FIGURE 3
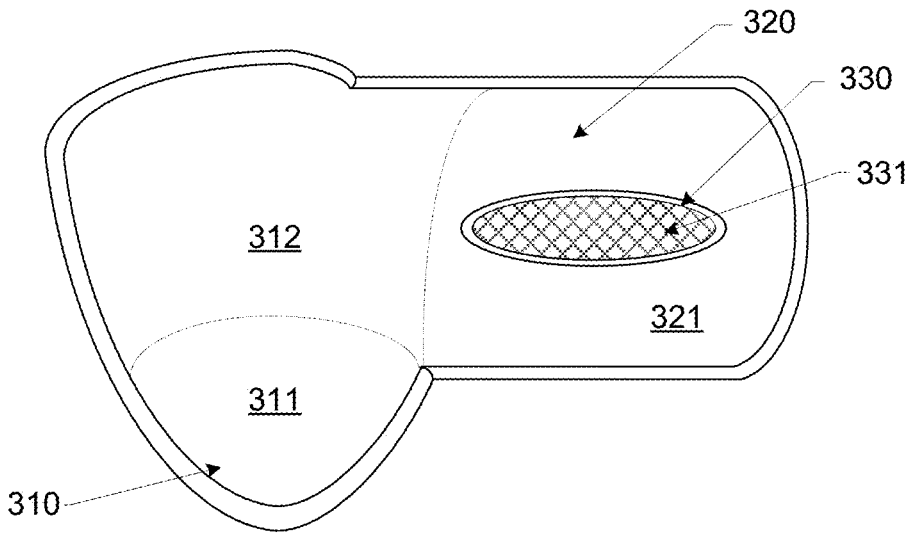
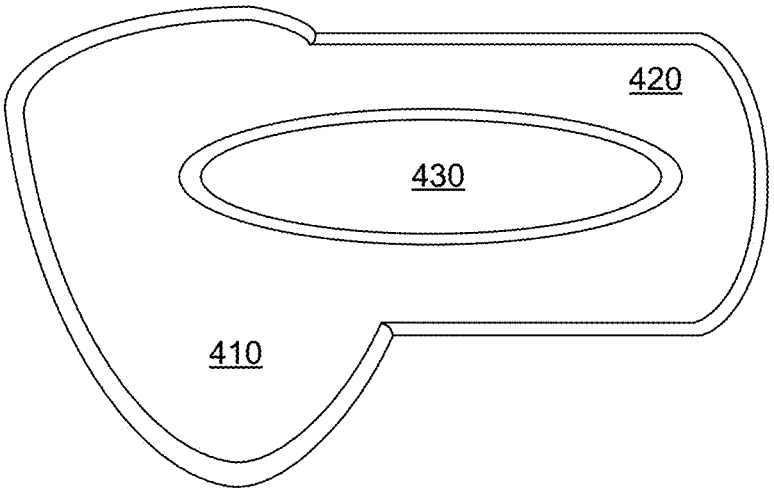
FIGURE 4

HAND-HELD TOOL

RELATED APPLICATIONS

The present application claims priority to U.S. Provisional Patent Application No. 63/036,680, filed on 9 Jun. 2020 and entitled "Improved Musical Pick," which is incorporated by reference herein in its entirety.

BACKGROUND

The present invention is generally directed to a user device that may encourage grip and control, while being used for detailed work. Specifically, the present invention is directed to a device that may be used as a plectrum for musical instruments, a tool for sculptures or craftsmen (for example, when forming clay), a device for detailed scraping and/or scratching, and/or a medical instrument used in various surgeries and procedures. The present invention may be formed with an integral handle for support, while also comprising an opening or aperture therein.

In playing a musical instrument such as a guitar, a banjo, or the like, musicians and users may utilize a pick to pluck, strum, or otherwise initiate vibration in the strings of the instrument. Traditionally, a pick is a small object held between a thumb and forefinger of the musician or user.

However, there are numerous difficulties regarding traditional picks. For example, users—particularly new or learning users—may encounter difficulties with maintaining a firm grip on the pick. A user's hand may become tired by the repeated striking of the strings during play, causing the musician to loosen his or her grip on the pick. Further, once the musician or user begins to sweat, perspiration often may reach the fingertips. Because most standard picks are smooth and flat, the musician's sweat may cause the surface of the pick to become wet and slippery, thereby making it increasingly difficult for the user or musician to maintain sufficient grasp of the pick.

If a user or musician loses grasp of the pick, the pick may be dropped, or move to an unusable position, often resulting in an interruption of playing. For example, while a pick may be dropped by a user, it is also common for the pick to rotate within a user's hand, the user often unaware of such rotation until attempted use of the pick. In the case of a student musician, such interruptions may impact the student's learning and speed with which abilities are learned.

In addition to the drawbacks noted above, given the planar nature of traditional picks, it is often difficult for users to understand where the pick is positioned, relative to their hand or fingers.

In addition to the drawback noted above, traditional picks may be comprised of materials such as wood or plastic that have sufficient flex. However, the solid planar nature of such traditional picks may limit the materials from which picks may be manufactured.

Similar drawbacks exist in other areas. For example, tools used for shaping and/or sculpting clay may become wet and slippery, causing the tool to move within the sculpture's or craftsman's hands. Medical tools may similarly become wet with various fluids, which may impact a user's grip, which may cause the tool to undesirably rotate, spin, or slid within a user's hand.

The present invention is directed at solving such drawbacks, disadvantages, and difficulties of the existing tools.

SUMMARY OF THE INVENTION

In accordance with some embodiments of the present invention, aspects may include a plectrum or pick, integrally formed from a single material and comprising an engagement portion for striking one or more strings of a musical instrument, a handle portion, configured such that a user may wrap his or her fingers (other than the index finger) around the handle, and an opening or orifice in the handle portion, and which may in some embodiments extend into the engagement portion, configured such that during use, a user may maintain skin-to-skin contact between fingers (i.e., index finger and thumb), or between fingers and portions of the user's hand.

In accordance with some embodiments of the present invention, the size and shape of the opening or orifice may change, at times dependent at least in part on the material from which the pick is manufactured. A larger opening or orifice may assist a pick comprised of a more rigid material in having a desired or necessary amount of flex or displacement during use.

In accordance with some embodiments of the present invention, aspects may further include the handle portion and, in some embodiments, part of the engagement portion, comprising additional elements to increase a user's grip of the pick. Such elements may include, but are not limited to, protrusions or indentions, additional holes or orifices, bumps, grooves, roughly sanded surfaces, and/or additional materials (such as elements attached to the pick, including but not limited to coatings, ridges, bump, etc.).

In accordance with some embodiments of the present invention, the pick may further include various coatings or coverings. For example, in accordance with some embodiments, a cloth, sponge, and/or a hydrophilic material may be disposed on the handle portion, or in the opening or orifice, which may be used to absorb a user's perspiration, thereby potentially assisting in maintain an adequate grip on the pick. Similarly, the handle portion and the top of the pick may be coated in a hydrophobic material, which may be utilized to transmit perspiration away from the portions of the pick grasped by the user.

These and other aspects will become apparent from the following description of the invention taken in conjunction with the following drawings, although variations and modifications may be affected without departing from the spirit and scope of the novel concepts of the invention

DESCRIPTION OF THE DRAWINGS

The present invention can be more fully understood by reading the following detailed description together with the accompanying drawings, in which like reference indicators are used to designate like elements. The accompanying figures depict certain illustrative embodiments and may aid in understanding the following detailed description. Before any embodiment of the invention is explained in detail, it is to be understood that the invention is not limited in its application to the details of construction and the arrangements of components set forth in the following description or illustrated in the drawings. The embodiments depicted are to be understood as exemplary and in no way limiting of the overall scope of the invention. Also, it is to be understood that the phraseology and terminology used herein is for the purpose of description and should not be regarded as limiting. The detailed description will make reference to the following figures, in which:

FIG. 3 illustrates an exemplary device with additional features, in accordance with some embodiments of the present invention.

FIG. 4 illustrates an exemplary device in accordance with some embodiments of the present invention.

Figure 1:
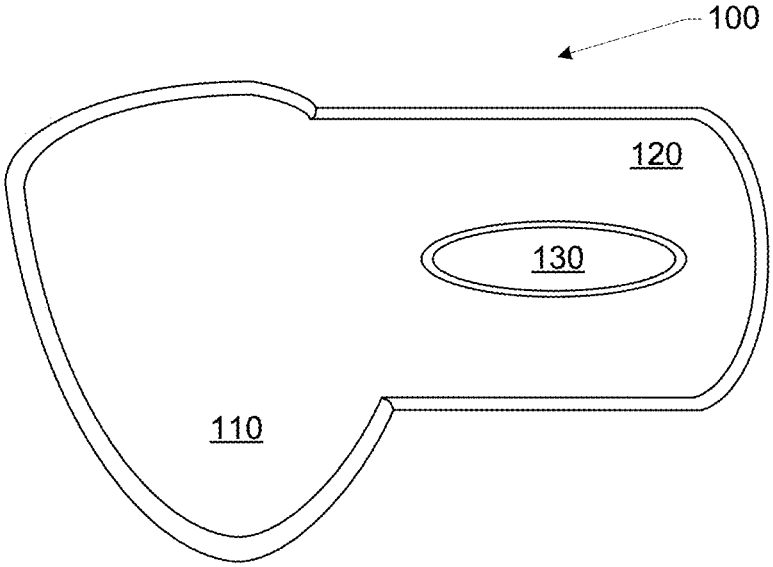
FIG. 1 illustrates an exemplary device in accordance with some embodiments of the present invention.

Before any embodiment of the invention is explained in detail, it is to be understood that the present invention is not limited in its application to the details of construction and the arrangements of components set forth in the following description or illustrated in the drawings. The present invention is capable of other embodiments and of being practiced or being carried out in various ways. Also, it is to be understood that the phraseology and terminology used herein is for the purpose of description and should not be regarded as limiting.

DETAILED DESCRIPTION

The matters exemplified in this description are provided to assist in a comprehensive understanding of various exemplary embodiments disclosed with reference to the accompanying figures. Accordingly, those of ordinary skill in the art will recognize that various changes and modifications of the exemplary embodiments described herein can be made without departing from the spirit and scope of the claimed invention. Descriptions of well-known functions and constructions are omitted for clarity and conciseness. Moreover, as used herein, the singular may be interpreted in the plural, and alternately, any term in the plural may be interpreted to be in the singular.

The present invention is generally directed to a user device that may encourage grip and control, while being used for detailed work. Specifically, the present invention is directed to a device that may be used as a plectrum for musical instruments, a tool for sculptures or craftsmen (for example, when forming clay), a device for detailed scraping and/or scratching, and/or a medical instrument used in various surgeries and procedures. The present invention may be formed with an integral handle for support, while also comprising an opening or aperture therein.

For example, the present invention may be directed to an improved guitar pick designed to be easier to hold and use and may, in some embodiments, include additional features to prevent the pick from spinning in a user's hand, and/or dropping the pick, which may be due to improper positioning, difficulty in grasping (for example, due to perspiration), and or other circumstances.

In accordance with some embodiments of the present invention, a device in accordance with some embodiments of the present invention may comprise an integral handle portion that may provide more surface contact between a user's thumb and finger (i.e., index finger), as well as an opening or orifice in the handle portion that may permit skin-to-skin contact between the user's fingers. The ability of a user to firmly grasp the device may permit a user to utilize the device at different angles. As the device is tapered to a rounded point, different angles may thereby change the contact area between the device and whatever it may be contacting. For example, in the use case of a musical plectrum different contact areas with a string of an instrument may vary, which may result in different tones from the musical instrument. In the use case of a sculpting tool and/or a scraping tool, the different contact areas and/or angles may impact the amount of material with which the tool engages.

Note that devices in accordance with the present invention may be comprised of any suitable material including, which may be selected based on the specific intended use. For example, in the case of a musical plectrum materials may include, but are not limited to, wood (of various types), plastics (such as nylon, celluloid, acetal (e.g., Delrin® from DuPont), etc.), composite materials (such as fiberglass, carbon fiber, etc.) metal, and/or any combination. Devices used as medical and/or surgical devices may be comprised of a non-toxic, non-reactive material that may be approved for such use, for example including silicone, and/or various non-porous plastics.

Material appropriate for the device may be selected based on the specific geometric configuration of the specific pick, including the size and orientation of an orifice or opening. For example, in the case of a musical plectrum, property characteristics that may impact the performance of a device may include (i) friction coefficient—that is, how well the device "slides" across the strings; (ii) hardness—resistance to wear; (iii) brittleness—or energy absorbed until fracture; (iv) stiffness—for example, the Young's modulus of the material; and (v) fatigue limit—how many times the device may be deflected until failure.

It is not uncommon for materials to be adequate or even desirable under elements (i), (ii), (iii), and (v) above, but not have sufficient "flex" to provide for clear and/or sharp notes. However, in accordance with some embodiments of the present invention, devices may be comprised of a stronger material—for example, a substantially planar piece of stainless steel, and may still have sufficient flex due to the positioning and orientation of the opening or orifice.

Note that while the device may have multiple uses (as discussed above), the following discussion predominantly focuses on the use of the device as a musical plectrum, or pick. Note that concerns regarding a user's grip are transferable to uses in the sculpture/pottery area, as well as the use case of a medical device. However, in order to present the following discussion in a clear and understandable manner, a single use case is predominantly discussed. This decision should not be used to limit the invention and/or the claims in any way, as the additional uses of the present invention are fully contemplated.

In addition, although the discussion may utilize the phrase "skin-to-skin" contact, it is fully contemplated that such contact may not always be direct skin to skin. For example, the in use case of a medical device or a pottery device, it is contemplated that a user may be wearing personal protection equipment, such as latex gloves, rubber gloves, or some other type of glove material. Such gloves may prevent actual skin from contacting skin. However, the user may be able to feel their own finger, thumb, and/or hand through the orifice, thereby providing better control and precision. Below discussions of "skin-to-skin" are to be interpreted as including contact between a user's fingers, thumbs, and/or hands even if covered with gloves or other material.

Similarly, in accordance with some embodiments of the present invention, an absorptive reservoir may be included. For example, an absorptive material (such as a hydrophilic cloth) may be disposed in one or more of the openings or orifices. However, it is fully contemplated that a user may still be able to feel his or her fingers, thumbs, and or hands through the cloth reservoir, thereby still providing the additional control and/or precision offered by the "skin-to-skin" contact. Note however, that some embodiments may set forth direct and actual skin touching skin.

With reference to FIG. 1, a device in accordance with some embodiments will now be discussed. Pick 100 may generally comprise an engagement portion 110, intended to strike, strum, or otherwise engage with one or more strings of a musical instrument; handle portion 120, which may comprise an integral extension of the engagement portion 110, that may be held by a user during use; and opening or orifice 130, which may permit skin-to-skin contact between a user's fingers, thumb, and/or hand through the pick 100.

Figure 2:
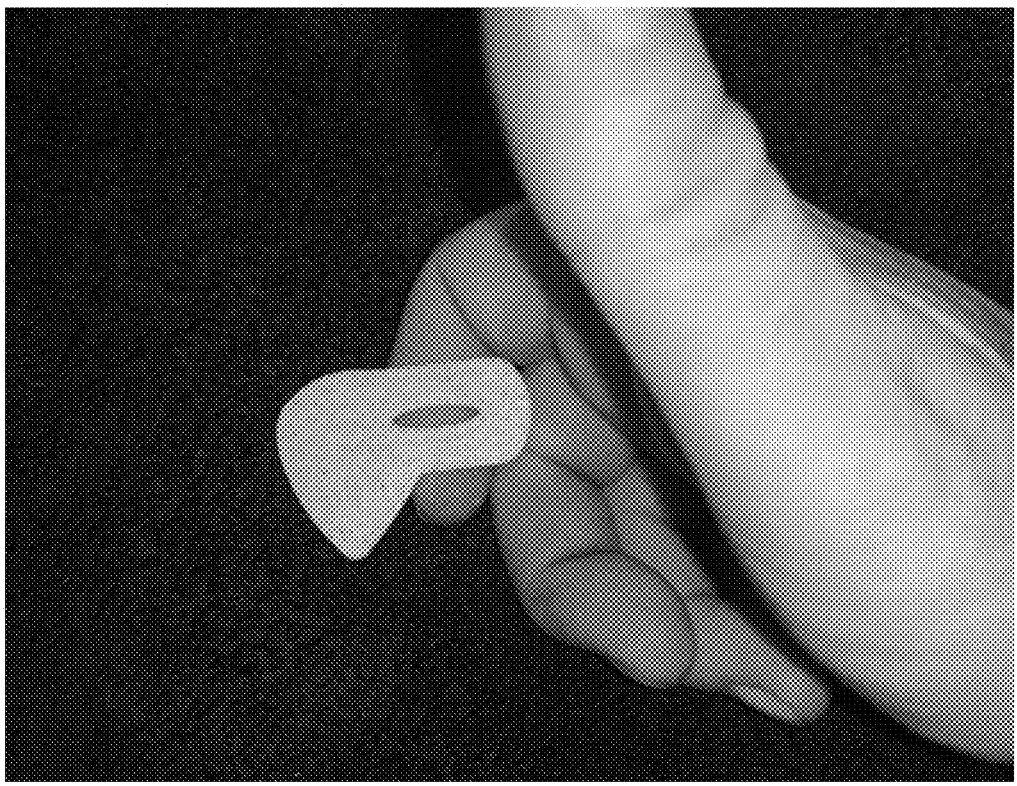
FIG. 2 illustrates an exemplary device held by a user, in accordance with some embodiments of the present invention.

Note that the pick may be made in any size suitable to be held and used for its intended purpose. Different sized users may utilize different size picks. Moreover, there ration of the area of the engagement portion and the handle portion may vary, again depending on user's comfort, desire, manufacturing capabilities or limitations, or even mere aesthetic desires. FIG. 2 shows a user holding a pick in accordance with some embodiments of the present invention.

Note that although the figures generally show the handle portion to be substantially perpendicular to the point of the engagement portion, this is not required or necessary. It is contemplated that the handle portion may be positioned at any angle relative to the engagement portion. In accordance with some embodiments of the present invention, the handle portion may be connected to the engagement portion via a moveable connection such that the angle between the engagement portion and the user portion may be selected by the user.

With reference to FIG. 3, a pick in accordance with some embodiments of the present invention may comprise different coatings, features, materials, etc. that may be utilized to increase or assist with a user's grip on the pick. As before, a pick may comprise an engagement portion 310, a handle portion 320, and an opening or orifice 330. However, different parts of the pick may be covered in different materials, coatings, or have additional elements present.

For example, at least an area 311 of engagement portion 310 may not have any coatings, coverings, or features, to not interfere with striking, strumming, picking, or otherwise engaging one or more strings of a musical instrument. However, in accordance with some embodiments, area 311 may comprise ridges, hooks, or other engagement features used to assist a user in plucking a string (that is, pulling the string away from the surface of the instrument). Area 312 may be the primary area pinched or held by a user and may be coated with a hydrophobic material. Alternatively, area 312 may have features to increase a user's grip, such as ridges, bumps, roughly sanded or textured surface, etc. In some embodiments, area 321 may comprise a hydrophobic coating or layer, which may draw any perspiration on the pick away from the area pinched or held by the user. In some embodiments, the opening or orifice 331 may comprise a cloth, sponge, or other reservoir to absorb at least some of the wicked or transferred perspiration or liquid.

With reference to FIG. 4, note that the size of the opening or orifice 430 may be quite large, and may span both the engagement portion 410 and the handle portion 420.

Figure 5:
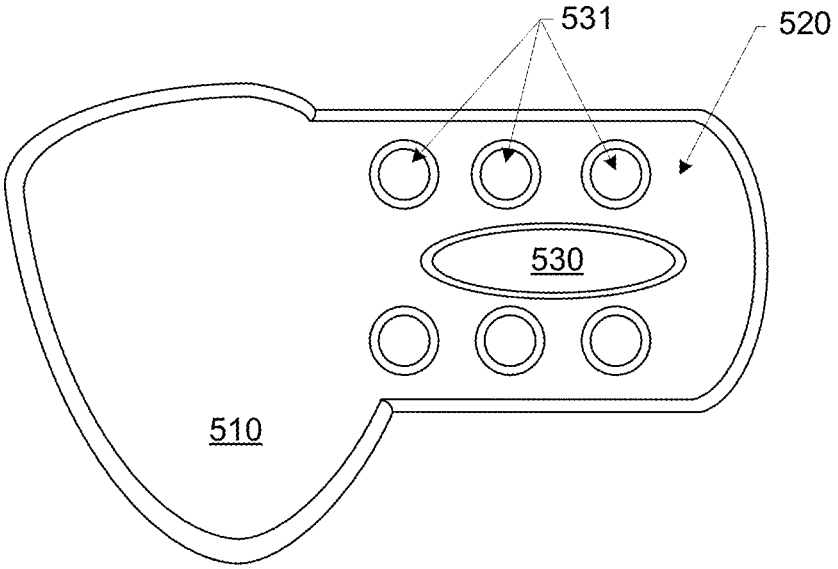
FIG. 5 illustrates an exemplary device in accordance with some embodiments of the present invention.
Figure 6:
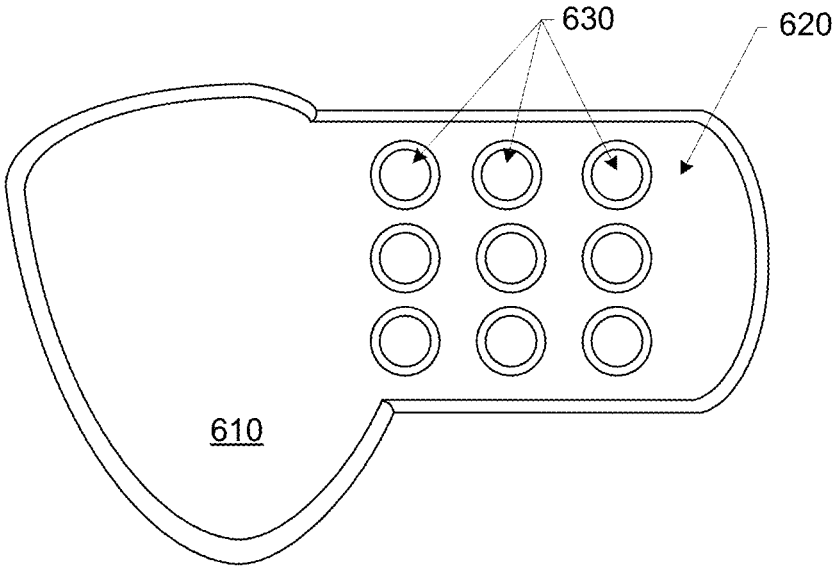
FIG. 6 illustrates an exemplary device in accordance with some embodiments of the present invention.

With reference to FIGS. 5 and 6, note that while the discussion above lists a single opening or aperture, it is contemplated that the invention may, in some embodiments, comprise multiple openings or orifices. FIG. 5 shows a pick with an engagement portion 510, handle portion 520, and primary orifice 530. However, additional openings 531 may be included which may assist in grip, distribution of perspiration, reduction of weight, increase in flex, be visually or aesthetically desirable, etc.

Similarly, FIG. 6 shows a pick with an engagement portion 610, a handle portion 620, and multiple openings 630. Note that while the openings are shown to be circular, it is contemplated that the openings may be of any shape or design. For example, multiple openings of different shapes (for example, hexagonal) could result in a honeycomb-like aesthetic.

Figure 7:
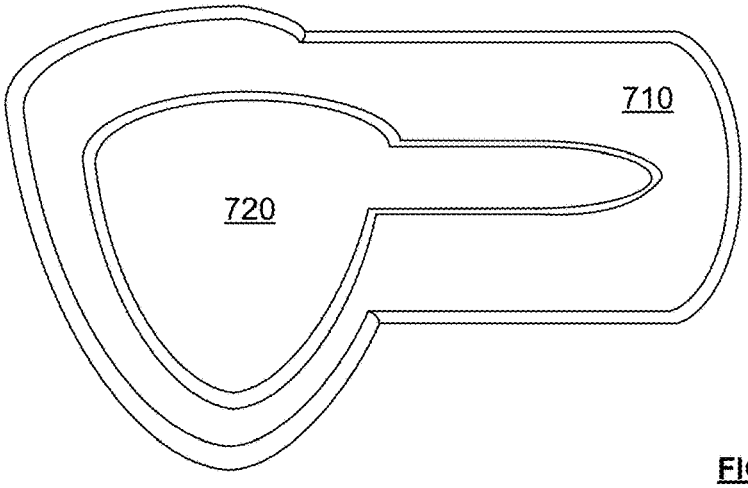
FIG. 7 illustrates an exemplary device in accordance with some embodiments of the present invention.

As noted above, picks may be made of different materials. If a material is desired that may not have sufficient or desirable flex, an opening or aperture in a pick may be extended throughout parts of the engagement portion. With reference to FIG. 7, an opening or aperture 720 may extend throughout the body of the pick 710. Note that this design may limit the solid portions of the pick which the user may need to pinch or hold. However, a balance can be struck between sufficient surface area for a user to grasp, and an opening or aperture sized to cause sufficient flex in the pick material.

Figure 8:
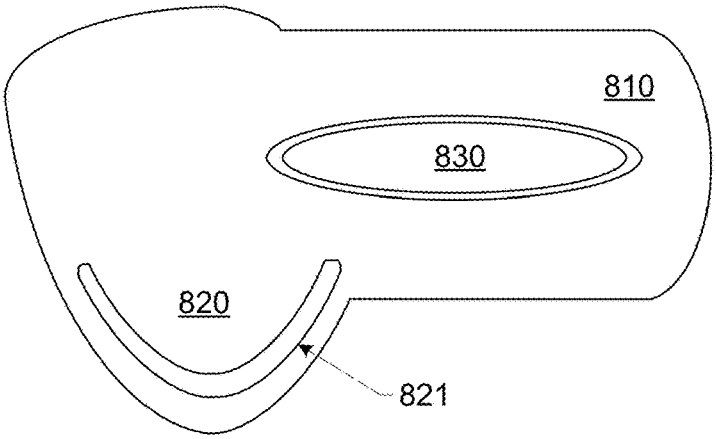
FIG. 8 illustrates an exemplary device in accordance with some embodiments of the present invention.

FIG. 8 illustrates a different arrangement, in which a leading edge of the engagement portion 820 of the pick may have an opening 821, not intended for skin-to-skin contact, but rather included to cause sufficient flex in the leading edge of the engagement portion. The pick handle 810 may comprise the opening 830 for skin to skin contact, as discussed in some embodiments above.

Note that most of the attached figures show a chamfer or rounded edge around the perimeter of the pick. This rounded edge or chamfer is not required in the invention, and if included may be of any shape, size, or radius. Moreover, if included such rounded edge or chamfer may extend around the entire perimeter of the pick, or may extend only over one or more portions (for example, where the pick is expected to strike, pluck, strum, or otherwise engage with one or more strings of a musical instrument. Note that FIG. 8 does not illustrate this chamfer or rounded edge.

Figure 9:
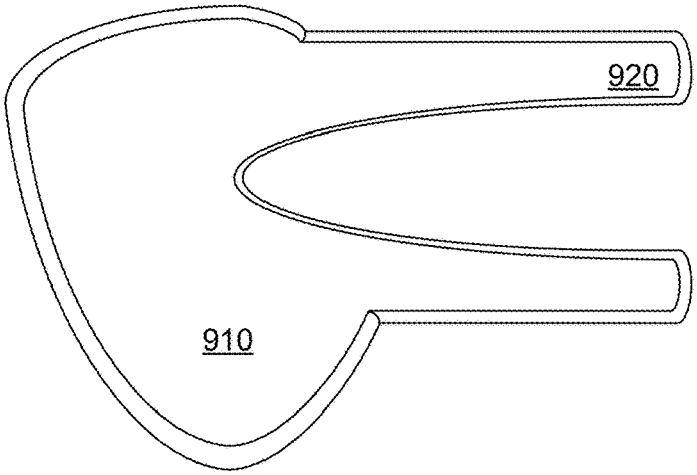
FIG. 9 illustrates an exemplary device in accordance with some embodiments of the present invention.

It is also contemplated that while the opening or aperture has been illustrated as a fully enclosed, opening, this is not required. FIG. 9 illustrates a pick in accordance with some embodiments of the present invention where the opening extends through the entire pick, leaving the engagement portion 910 and the handle portion 920 to be effectively divided.

Moreover, note that the ratio of pick body or handle and engagement portion to opening can vary depending on the design, user, material, etc. For example, in accordance with some embodiments of the present, the handle portion may be approximately similar in width to the engagement portion. In accordance with some embodiments, the handle portion may be approximately 40% as tall as the engagement portion, though it is also contemplated that the handle portion may be anywhere from 10% to 90% as compared to the engagement portion of the pick.

It will be understood that the specific embodiments of the present invention shown and described herein are exemplary only. Numerous variations, changes, substitutions and equivalents will now occur to those skilled in the art without departing from the spirit and scope of the invention. Accordingly, it is intended that all subject matter described herein and shown in the accompanying drawings be regarded as illustrative only, and not in a limiting sense.

I claim:

1. A tool integrally formed from a single material and comprising:

an engagement portion, with a bottom surface configured to contact, strike, or otherwise engage a target material, device, or item;

a handle portion extending laterally from a side of the engagement portion, configured to receive a user's fingers, thumbs, or hands wrapped there around;

one or more openings or orifices in the handle portion, configured such that during a use a user may maintain skin-to-skin contact between the user's fingers, thumb, and/or hand;

wherein at least a portion of the handle portion prevents the tool from rotating or spinning in the user's fingers, thumb and/or hand during use.

2. The tool of claim 1, wherein the tool is used as a musical plectrum and the engagement portion is configured for striking, plucking, or otherwise contacting a string on a musical instrument.

3. The tool of claim 1, wherein the tool is used as a shaping device in pottery or sculpture.

4. The tool of claim 1, wherein the tool is used as a scraping or scratching device.

5. The tool of claim 1, further comprising a pinch portion disposed between the engagement portion and the handle portion, the pinch portion configured to be gripped or pinched by a user's fingers and/or thumbs.

6. The tool of claim 1, wherein the one or more openings or orifices extend across the handle portion and the engagement portion.

7. The tool of claim 1, further comprising one or more openings or orifices are disposed in the engagement portion.

8. The tool of claim 1, wherein the one or more openings or orifices are formed from a cut-out or indent in the handle portion, and wherein the aperture is partially surrounded by the handle portion.

9. The tool of claim 1, further comprising one or more protrusions, indents, textures, ridges, or other surface features configured to assist with a user's grip of the tool.

10. The tool of claim 1, wherein the size and shape of the one or more openings or orifices changes the flexibility of the tool.

11. The tool of claim 1, wherein handle portion has a hydrophobic coating.

12. A tool integrally formed from a single material and comprising:

an engagement portion, with a bottom surface configured to contact, strike, or otherwise engage a target material, device, or item;

a handle portion, extending laterally from a side of the engagement portion and configured to receive a user's fingers, thumbs, or hand wrapped therearound, the handle portion comprising one or more non-circular openings or orifices configured such that during a use a user may maintain skin-to-skin contact between the user's fingers, thumb, and/or hand;

wherein when gripped by the user, the handle portion extends from the engagement portion into or towards the user's hand, thereby providing additional stability and control of the tool and prevents the tool from rotating or spinning in the user's fingers, thumb and/or hand during use.

13. The tool of claim 10, wherein the tool is comprised of wood, nylon, celluloid, acetal, Delrin, fiberglass, carbon fiber, metal, silicone, non-porous plastics, or any combination thereof.

14. The tool of claim 10, wherein the tool further comprises one or more protrusions, indents, textures, ridges, or other surface features configured to assist with a user's grip of the tool.

15. A tool integrally formed from a single material and comprising:

an engagement portion with a bottom surface configured to contact, strike, or otherwise engage a target material, device, or item;

a handle portion, extending laterally from a side of the engagement portion and configured to receive a user's fingers, thumbs, or hand wrapped therearound, the handle portion comprising one or more openings or orifices, configured such that during a use a user may maintain skin-to-skin contact between the user's fingers, thumb, and/or hand;

wherein:

the handle portion comprises one or more protrusions, indents, textures, ridges, or other surface features configured to assist with a user's grip of the tool;

when gripped by the user, the handle portion extends from the engagement portion into or towards the user's hand, thereby providing additional stability and control of the tool and prevents the tool from rotating or spinning in the user's fingers, thumb and/or hand during use.

16. The tool of claim 15, wherein the tool is used as a musical plectrum and the engagement portion is configured for striking, plucking, or otherwise contacting a string on a musical instrument.

* * * * *